US006378564B1

(12) United States Patent
Fumex

(10) Patent No.: US 6,378,564 B1
(45) Date of Patent: Apr. 30, 2002

(54) DEVICE FOR COUPLING A HEDDLE FRAME ON A MOTION-TRANSMISSION ELEMENT

(75) Inventor: André Fumex, Talloires (FR)

(73) Assignee: Staubli Faverges, Faverges (FR)

( * ) Notice: Subject to any disclaimer, the term of this patent is extended or adjusted under 35 U.S.C. 154(b) by 0 days.

(21) Appl. No.: 09/965,891

(22) Filed: Oct. 1, 2001

(30) Foreign Application Priority Data

Oct. 6, 2000 (FR) ..... 00 12840

(51) Int. Cl.[7] ..... D03C 9/06
(52) U.S. Cl. ..... 139/82; 139/57
(58) Field of Search ..... 139/57, 82

(56) References Cited

U.S. PATENT DOCUMENTS 4,422,481 A * 12/1983 Palau ..... 139/88
4,877,060 A 10/1989 Forment et al.
5,152,324 A 10/1992 Froment
5,348,054 A * 9/1994 Oertli ..... 139/57
6,145,548 A * 11/2000 Fumex ..... 139/57

FOREIGN PATENT DOCUMENTS

| | | |
|---|---|---|
| BE | 1009241 | 1/1997 |
| EP | 0297003 | 12/1988 |
| EP | 0467808 | 1/1992 |
| EP | 0709504 | 5/1996 |

* cited by examiner

*Primary Examiner*—Andy Falik
(74) *Attorney, Agent, or Firm*—Dowell & Dowell, P.C.

(57) ABSTRACT

A connecting device for connecting a motion transmission element to a heddle frame in a weaving loom wherein the connection device includes a tenon member and mortise member which are cooperatively engaged with respect to one another. The tenon member includes a nut mounted to the transmission element, an anchoring block through which the transmission element extends and which cooperates with surfaces of the mortise member, a bush through which the transition element passes and which bush cooperates in rotation with the nut and which also includes a counter-nut for securing the bush against the anchoring block.

11 Claims, 4 Drawing Sheets

X1
62
20
22
29
56
55
l29
21
59
60
46
27
50
51
52
45
28
26₂
101
L
l101
26₁
24
25
44
53
54
41
l54
42
43
100
14
13
1
9a
9
12
11
X-X'
X2

DEVICE FOR COUPLING A HEDDLE FRAME ON A MOTION-TRANSMISSION ELEMENT

BACKGROUND OF THE INVENTION

The present invention relates to a device for coupling a heddle frame on a movement-transmission element of a weave system. The invention also relates to an assembly for driving the heddle frames, to a weaving loom incorporating such a device, and to a weaving loom equipped with such a device or such an assembly.

DESCRIPTION OF THE RELATED ART

It is known to provide mechanical systems for connecting the frames of a weaving loom with rods or cables driven with a vertical oscillating movement by a weave system, particularly a dobby. EP-A-0 297 003 and EP-A-0 467 808 provide using elements forming tenon and mortise respectively, this allowing an efficient and rapid anchoring of the frame on the transmission element. However, such known devices present certain limitations.

The device of EP-A-0 297 003 provides a longitudinal adjustment of the tenon on a movement-transmission rod by adherence and wedging, thanks to wedde-shaped elements. In the event of poor clamping of these elements, a considerable risk of slide exists, which may lead to serious damage to the weaving loom, particularly by blockage of the frames and/or breakage of the connecting rods.

The device of EP-A-0 467 808 provides that the adjustment in height is of the micrometric type thanks to a tenon comprising a tapped central orifice, which avoids risks of untimely slide. However, this device is such that the surfaces of the tenon and mortise in contact are relatively small, while intense efforts are transmitted thanks to these surfaces, with considerable accelerations, hence a risk of premature wear of these surfaces by caulking.

It is a particular object of the present invention to overcome these drawbacks by proposing a novel coupling device in which a member forming tenon is secured with respect to a movement-transmission element, while the surfaces in contact of this tenon-forming element and of the mortise-forming element associated therewith are sufficiently large to withstand intense efforts.

SUMMARY OF THE INVENTION

To that end, the invention relates to a device for coupling a heddle frame on a movement-transmission element of a weave system, this device comprising a male member forming tenon mounted on the transmission element and a female member forming mortise fixed on an upright of the frame, the mortise member being provided with a central slot for passage of the transmission element and defining, on either side of this slot, contact surfaces intended to cooperate with the tenon member for transmission of the efforts, characterized in that the tenon member is formed by an assembly comprising:

- a nut screwed on the transmission element;
- an anchoring block forming at least two surfaces intended to cooperate with the contact surfaces of the mortise member, this block being provided with a through bore for passage of the transmission element and for reception, with possibility of rotation, of the nut,
- a bush provided with a central bore for passage of the transmission element and adapted to drive the nut in rotation about the transmission element, through the bore of the block, and
- a counter-nut for clamping the bush against the aforementioned block and nut.

Thanks to the invention, the dimensions of the block may be provided so that its surfaces intended to cooperate with the mortise member are relatively large, while the adjustment of the longitudinal position of the tenon member does not oblige the block to undergo a movement of rotation about the threaded rod constituting the transmission element, which would not be compatible with the usual density of implantation of the frames in a weaving loom. In other words, the nut and the bush make it possible to obtain adjustment of the position of the block along the transmisison element without inducing rotation of this block, the block thus being able to conserve a suitable orientation with respect to the mortise element borne by the frame.

According to advantageous aspects of the invention, the device incorporates one or more of the following characteristics:

The nut and the bush are provided with elements in relief of corresponding shapes allowing a claw coupling of the nut and the bush.

The bush is provided with a polygonal-section head, enabling it to be driven in rotation by means of a conventional spanner.

The bore of the block comprises two inner shoulders turned respectively towards the two openings of this bore and intended to cooperate respectively with corresponding surfaces of the nut and of the bush. These two inner shoulders make it possible to control the position of the block along the transmission element thanks to the nut and the bush.

The block is provided with at least one protuberance adapted to be engaged in the slot of the mortise member. This protuberance ensures a suitable positioning of the block with respect to the mortise member and to the environment of the frame.

The block is provided with an extension directed opposite the mortise member when the tenon member is in place in the mortise member, this extension being adapted to be engaged in a slideway for guiding and retaining the tenon member. In that case, this extension advantageously presents a transverse section substantially in the form of a T.

The invention also relates to an assembly for driving the heddle frames of a weaving loom, which comprises at least one device as described hereinbefore and a set of guides adapted each to receive an extension of the block of such a device, each guide presenting, in transverse section, a shape such that it opposes an extraction of the extension in a direction substantially perpendicular to the direction of slide of the extension in the guide in question. In addition, the guide may be provided to be mobile in a direction substantially perpendicular to the direction of slide, which makes it possible to control a movement of introduction/extraction of the tenon member with respect to the mortise member.

Finally, the invention relates to a weaving loom equipped with a device or an assembly as described hereinbefore. Such a loom is easier to use, particularly when frames are changed, which is a regular process during use of such a loom.

BRIEF DESCRIPTION OF THE DRAWINGS

The invention will be more readily understood on reading the following description of an embodiment of a device and assembly in accordance with its principle employed in a loom likewise according to the invention, description given solely by way of example and made with reference to the accompanying drawings, in which.

DESCRIPTION OF PREFERRED EMBODIMENT

Figure 1:
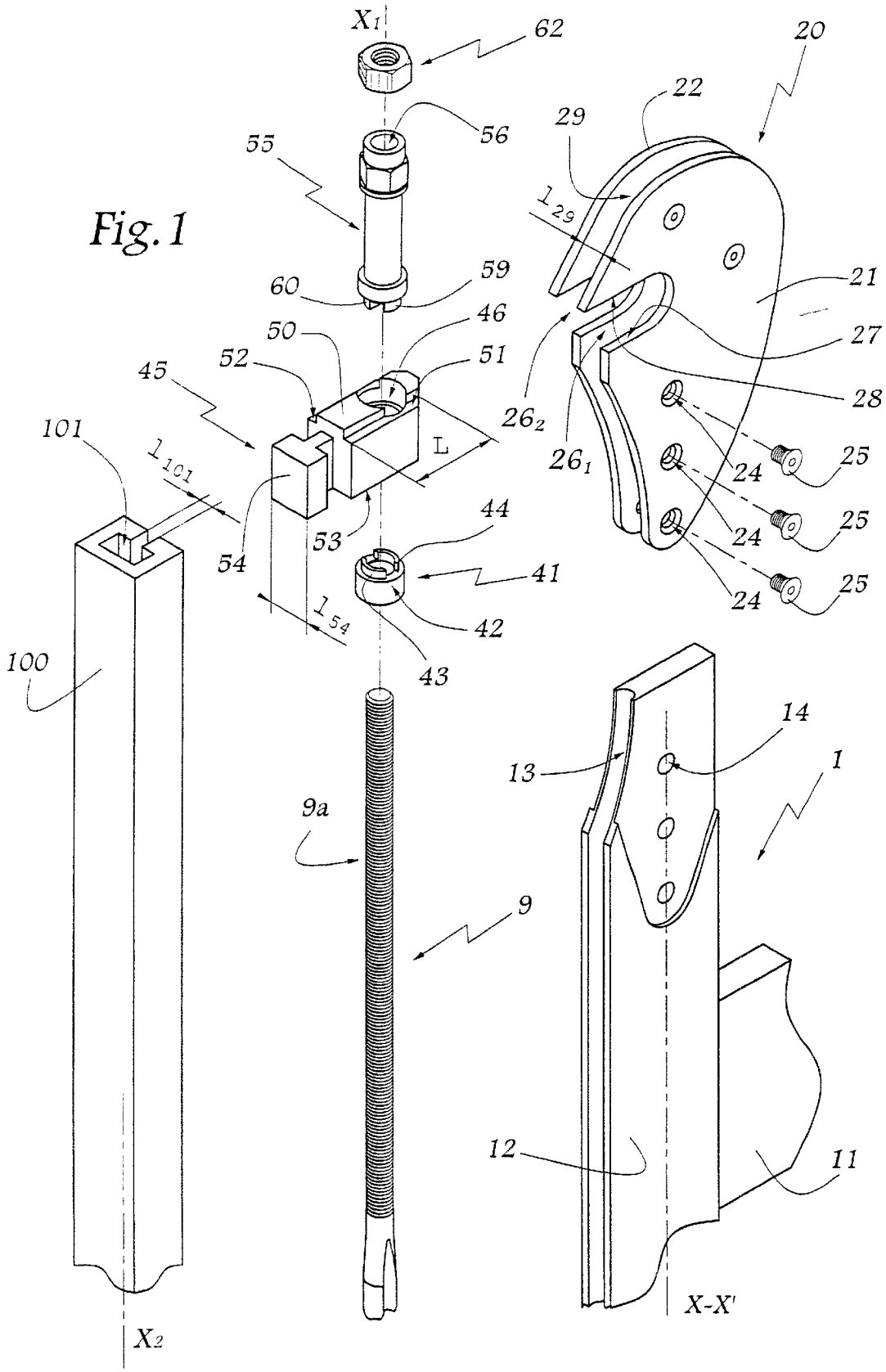
FIG. 1 is an exploded view in perspective of a device according to the invention.
Figure 2:
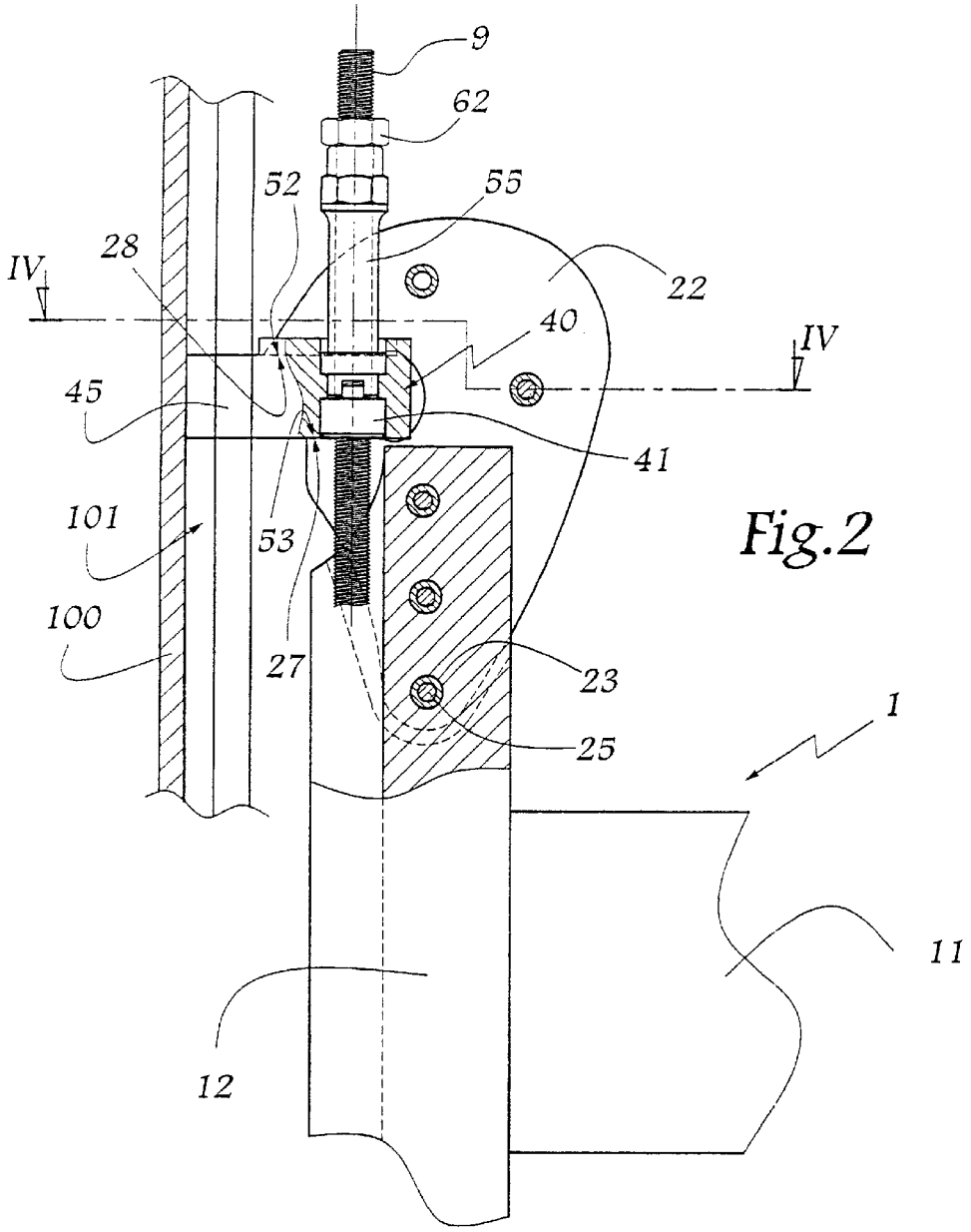
FIG. 2 is a longitudinal section of the device of FIG. 1 in mounted configuration.
Figure 4:
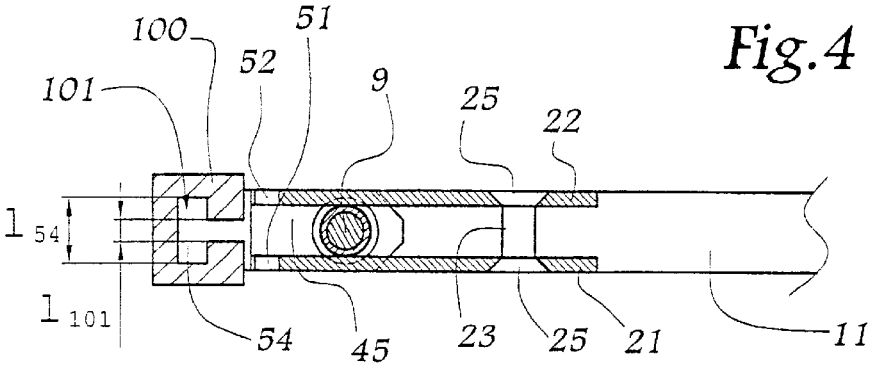
FIG. 4 is a section along line IV—IV in FIG. 2.

Referring now to the drawings, a heddle frame 1 of a loom M is intended to be driven by a dobby 2 thanks to movement-transmission elements which include a rod 3 for connection between the dobby and a bent lever 4, this lever and this rod being connected by a synchronism bar 5 to a second bent lever (not shown) disposed on the other side of the loom M. The bent lever 4 is connected by a rod 6 to a slide block 7 guided by rails 8 and 8'. The slide block is itself connected to an elongated effort-transmission element which is formed by a rod 9 threaded over at least a part of its height.

Reference 11 denotes the upper upright of the frame 1 and 12 its lateral upright on the rod 9 side. The upright 12 has a longitudinal groove 13 with rounded bottom cut out therein for receiving the rod 9. The upright 12 is likewise provided with three through orifices 14 allowing the mounting of an attachment 20 forming mortise, and which is constituted by two vertical plates 21 and 22, between which a spacer member 23 is arranged. The plates 21 and 22 are provided with three orifices 24 provided to be aligned with the orifices 14 when the attachment 20 is mounted on the frame 1. Screws 25 or rivets allow the attachment 20 to be immobilized on the frame 1 by traversing the orifices 14 and 24.

Each plate 21 and 22 has a notch 261, 262 respectively cut out therein, oriented on the groove 13 side when the attachment 20 is mounted on the frame 1. X–X' denotes the principal direction of the lateral upright 12 of the frame 1. The notches 26, and 262 are respectively defined by lower edges 27 and upper edges 28, these edges 27 and 28 being substantially perpendicular to the direction X–X', i.e. substantially horizontal, when the loom is in configuration of use.

A space is defined between the plates 21 and 22. This elongated space constitutes a slot 29 for partially receiving the rod 9, as will be described below.

An assembly 40 forming a tenon is provided to be mounted on the rod 9 and introduced partially in the notches $\mathbf{26}_1$ and $\mathbf{26}_2$ in order to interact with the edges 27 and 28.

This assembly 40 comprises a nut 41 intended to be screwed on a threaded part 9*a* of the rod 9. This nut 41 has a substantially cylindrical outer radial surface 42 and presents two teeth 43 and 44 each extending in a direction substantially parallel to a central axis $X_1$ of the rod 9 when the nut 41 is in place on this rod.

The assembly 40 also comprises a block 45 provided with a through bore 46 which is not tapped and whose dimensions are such that the block 45 may freely slide around the threaded part 9*a*.

Figure 3:
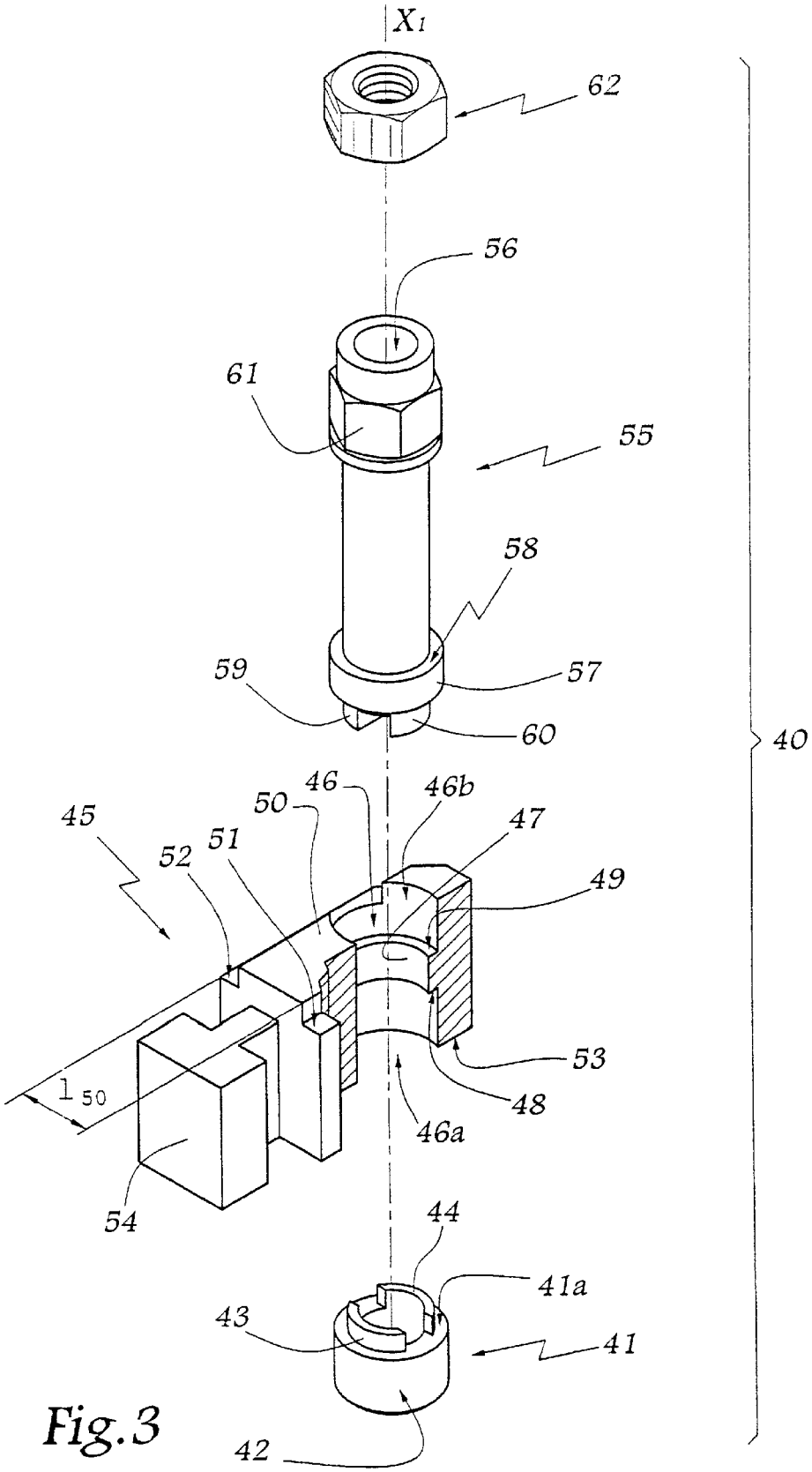
FIG. 3 is an exploded view in perspective, on a larger scale and with parts cut away, of the element forming tenon.

As is more clearly visible in FIG. 3, the inner radial surface of the bore 46 is provided with a flange 47 defining two shoulders 48, 49 respectively oriented towards the lower opening 46*a* and towards the upper opening 46*b* of the bore 46. When the block 45 rests on the nut 41, the shoulder 48 is in abutment on the upper surface 41*a* of the nut 41.

The block 45 is provided with a protuberance 50 whose width $L_{50}$ is slightly less than the width 129 of the slot 29, with the result that this protuberance 50 may be engaged in the slot 29 of the attachment 20. The protuberance 50 is interrupted by the bore 46.

On either side of the protuberance 50 there are defined two surfaces 51 and 52 intended to come into abutment against the upper edges 28 of the notches $\mathbf{26}_1$ and $\mathbf{26}_2$. The length L of the surfaces 51 and 52 is relatively great, which allows a distributed abutment of the block 45 on the edges 28.

The lower surface 53 of the block 45, i.e. the surface opposite surfaces 51 and 52, forms a bearing surface engaged by the edges 27 of the notches $\mathbf{26}_1$ and $\mathbf{26}_2$.

According to an embodiment of the invention which has not been shown, it would be possible to provide a protuberance similar to protuberance 50 on surface 53.

The block 45 is also provided with an extension 54 of substantially T-shaped cross-section, which is intended to be engaged in a guide in the form of a slideway 100 defining a groove 101 with an inner section substantially in the form of a T. The minimum width $\mathbf{1}_{101}$ of the groove 101 is less than the maximum width $\mathbf{1}_{54}$ of the extension 54, with the result that, once engaged in the groove 101, the extension 54 cannot be displaced in the plane of the frame in a direction Y–Y' perpendicular to its direction $X_2$ of slide in the guide 100.

A bush 55 also belongs to the assembly 40 and is provided with a central bore 56 of sufficient diameter to allow the bush 55 to slide around the part 9*a* of the rod 9. The bush 55 is provided with an outer radial flange 57 intended to come into abutment against the shoulder 49 when the lower part 58 of the flange 57 is engaged in the bore 46. Part 58 is provided with teeth 59 and 60 adapted to mesh with teeth 43 and 44 of the nut 41, through the bore 46, which allows elements 41 and 55 to be connected in rotation.

The bush 55 is also provided with a hexagonal or other polygonal shaped head 61 allowing it to be rotated with the aid of a conventional spanner A counter-nut 62 is also provided in the assembly 40 which is screwed on part 9*a* of the rod 9 in order to block the bush 55 against the block 45 and the nut 41. The tenon member 40 therefore comprises an assembly formed by elements 41, 45, 55 and 62.

Thanks to the dimensions of the surfaces 51, 52 and 53, the tenon member 40 bears against the mortise member 20 over relatively large areas, which avoids a caulking of surfaces 51 to 53 or of edges 27 and 28.

Adjustment of the position of the assembly 40 along the rod 9 is micrometric and effected thanks to the nut 41 on which th bush 45 rests. In effect, when the position of the assembly 40 is to be adjusted, it suffices to rotate the bush 55 by hand to drive the nut 41 in rotation, which then rotates freely inside the bore 46 and moves along the rod 9, driving the block 45 in translation without driving it in rotation. When the desired position is attained, it suffices to tighten the counter-nut 62 against the bush 55 by using the hexagonal head 61, which has the effect of firmly immobilizing the assembly 40, and in particular the block 45, on the rod 9. The longitudinal position of the assembly 40 is adjusted with respect to the rod 9 without the block 45 being rotated, which makes it possible to maintain the extension 54 in place in the guide 100 and avoids an interference between adjacent tenon members in a weaving loom.

Elements 50 and 54 both have the function of guaranteeing correct positioning of the block 45 with respect to the slot 29 and, in a variant, one only of these elements may be employed on a block of a device according to the invention.

The invention presents the particular advantage that, in the event of a restricted number of heddle frames being used for weaving a piece of material, the rods 9 which are not associated with frames are maintained in substantially vertical positions by the cooperation of the extensions 54 and of the guides 100, with the result that they cannot fall or get hooked.

Figure 5:
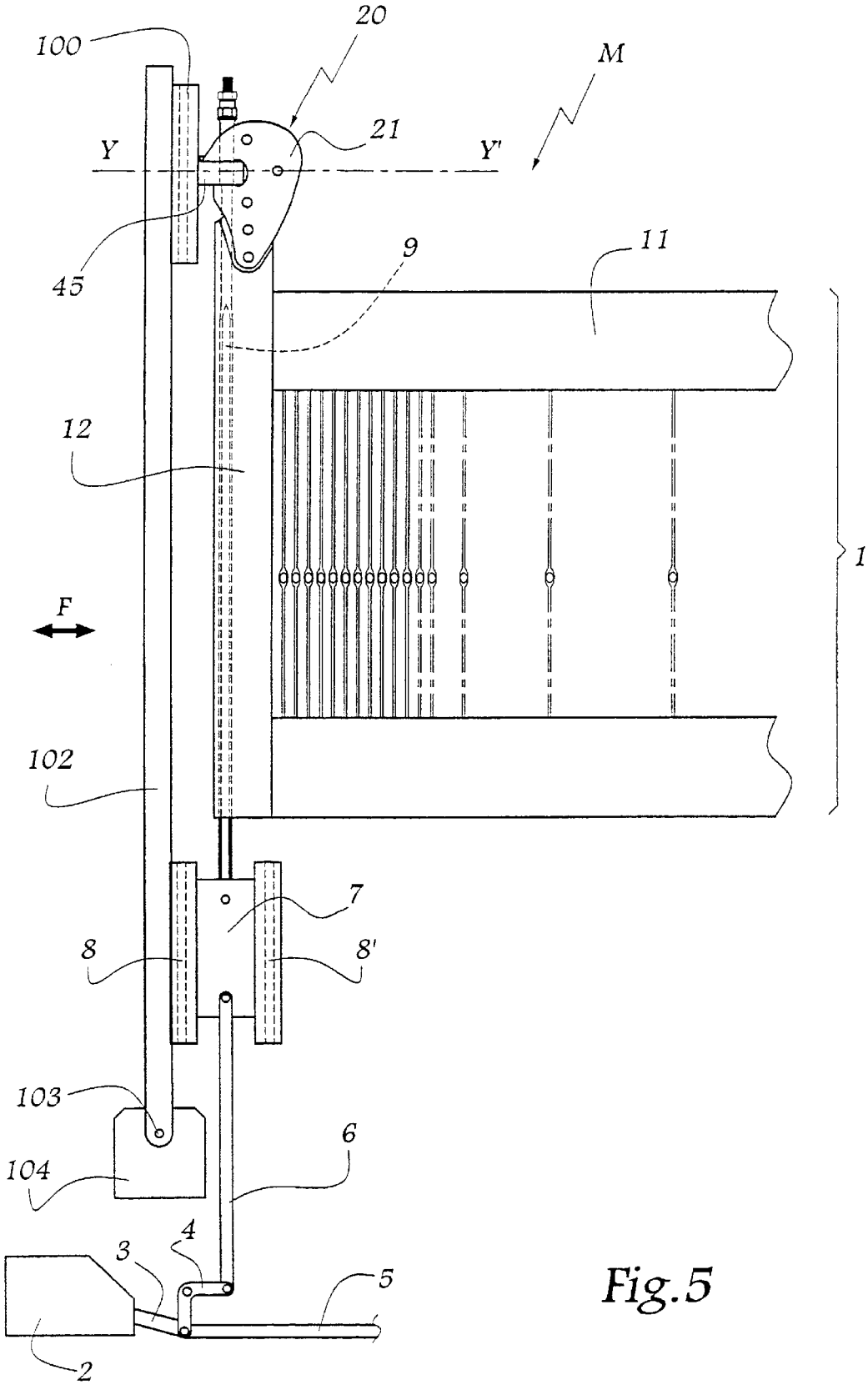
FIG. 5 schematically shows part of a weaving loom according to the invention.

As is more clearly visible in FIG. 5, each guide 100 may be mounted on a support 102 articulated about an axis 103 with respect to an element 104 of the framework of the loom M, which makes it possible to envisage a movement F transverse with respect to the direction X–X', i.e. a movement of approach or of moving away of the guides 100 and of the tenon members 40 of the loom with respect to the mortise members 20 in direction Y–Y'.

One sole support 102 may, of course, be used for all the guides 100 of a weaving loom.

As is also visible in FIG. 5, the guide rails 8 and 8' may be supported by the support 102, which enables each rod 9 to be pivoted over the whole of its length.

Other modes of adjusting the position of the tenon members in the direction Y–Y' may be considered, such as adjusting members incorporating a screw, eccentric or slideway.

In any case, an assembly for driving the frames in the weaving loom according to the invention allows an easy and simultaneous positioning of the tenon members associated with the movement-transmission elements in the mortise members associated with different frames, possibly with the assistance of a motor.

The invention has been shown with a positive dobby. It is, of course, applicable with a negative dobby, such as the one disclosed, for example, in EP-A-0 297 003 and, more generally, in any weaving loom in which the heddle frames must be set in motion, for example with a cam mechanism.

What is claimed is:

1. A device for connecting a heddle frame of a weaving system to a transmission element for transmitting force to move the heddle frame, the device comprising a tenon member mounted on said transmission element and a mortise member secured on an upright of said heddle frame, said mortise member being provided with a slot in which said transmission element extends, said mortise member including contact surfaces on either side of said slot which cooperate with the tenon member for transmitting the force to move the heddle frame, said tenon member being formed by an assembly including:

a nut screwed on said transmission element;

an anchoring block having at least two surfaces which cooperatively engage the contact surfaces of the mortise member, said block being provided with a bore through which said transmission element extends and in which said nut is rotatably received, a bush provided with a central bore through which said transmission element passes, said bush being received within said bore of said block and being adapted to drive said nut in rotation about said transmission element by a driving engagement through said bore of said block, and a counter-nut adjustably mounted to said transmission element urging said bush against said block.

2. The device of claim 1, wherein said nut and said bush are provided with teeth elements for rotationally coupling said nut and said bush.

3. The device of claim 1, wherein said bush is provided with a polygonal shaped head.

4. The device of claim 1, wherein said bore of said block includes two oppositely oriented inner shoulders which cooperate, respectively, with surfaces of said nut and of said bush.

5. The device of claim 1, wherein said block is provided with at least one protuberance which extends within said slot of said mortise member.

6. The device of claim 1, wherein said block is provided with an extension directed opposite said mortise member when a portion of said tenon member is positioned within said mortise member, said extension being adapted to be engaged in a slideway for guiding and retaining said tenon member.

7. The device of claim 6, wherein said extension includes a transverse section substantially in the form of a T.

8. An assembly for driving heddle frames of a weaving loom, the assembly including:

a) a plurality of connecting devices for drivingly connecting the heddle frames to transmission elements for transmitting forces to move the heddle frames, each of said connecting devices including a tenon member mounted on said transmission element and a mortise member secured on an upright of said heddle frame, said mortise member being provided with a slot in which said transmission element extends, said mortise member including contact surfaces on either side of said slot which cooperate with the tenon member for transmitting the force to move the heddle frame, said tenon member being formed by an assembly including:

a nut screwed on said transmission element;

an anchoring block having at least two surfaces which cooperatively engage the contact surfaces of the mortise member, said block being provided with a bore through which said transmission element extends and in which said nut is rotatably received, a bush provided with a central bore through which said transmission element passes, said bush being received within said bore of said block and being adapted to drive said nut in rotation about said transmission element by a driving engagement through said bore of said block, and a counter-nut adjustably mounted to said transmission element urging said bush against said block;

b) each of said blocks including an extension element; and c) a plurality of guides each of which defines a guide groove having a cross sectional configuration such that an extension element of at least one of said blocks is cooperatively received therein so as to be slidable relative to a length of said guide groove without said extension element being displaceable therefrom in a direction substantially perpendicular to a length of said guide groove.

9. The assembly of claim 8 wherein each of said guides is movable in a direction substantially perpendicular to the length of said guide grooves.

10. A weaving loom including a drive system and a plurality of heddle frames, an assembly for driving the heddle frames, the assembly including:

a) a plurality of connecting devices for drivingly connecting the heddle frames to transmission elements for transmitting forces to move the heddle frames, each of said connecting devices including a tenon member mounted on said transmission element and a mortise member secured on an upright of said heddle frame, said mortise member being provided with a slot in which said transmission element extends, said mortise member including contact surfaces on either side of said slot which cooperate with the tenon member for transmitting the force to move the heddle frame, said tenon member being formed by an assembly including:

a nut screwed on said transmission element;

an anchoring block having at least two surfaces which cooperatively engage the contact surfaces of the mortise member, said block being provided with a bore through which said transmission element extends and in which said nut is rotatably received, a bush provided with a central bore through which said transmission element passes, said bush being received within said bore of said block and being adapted to drive said nut in rotation about said transmission element by a driving engagement through said bore of said block, and a counter-nut adjustably mounted to said transmission element urging said bush against said block;

b) each of said blocks including an extension element; and c) a plurality of guides each of which defines a guide groove having a cross sectional configuration such that an extension element of at least one of said blocks is cooperatively received therein so as to be slidable relative to a length of said guide groove without said extension element being displaceable therefrom in a direction substantially perpendicular to a length of said guide groove.

11. A weaving loom including a drive system and at least one heddle frame, a device for connecting said at least one heddle frame to a transmission element for transmitting force to move said at least one heddle frame, said device including a tenon member mounted on said transmission element and a mortise member secured on an upright of said at least one heddle frame, said mortise member being provided with a slot in which said transmission element extends, said mortise member including contact surfaces on either side of said slot which cooperate with the tenon member for transmitting the force to move said at least one heddle frame, said tenon member being formed by an assembly including:

a nut screwed on said transmission element;

an anchoring block having at least two surfaces which cooperatively engage the contact surfaces of the mortise member, said block being provided with a bore through which said transmission element extends and in which said nut is rotatably received, a bush provided with a central bore through which said transmission element passes, said bush being received within said bore of said block and being adapted to drive said nut in rotation about said transmission element by a driving engagement through said bore of said block, and a counter-nut adjustably mounted to said transmission element urging said the bush against said block.

* * * * *